US006828942B2

(12) United States Patent
Louzir et al.

(10) Patent No.: US 6,828,942 B2
(45) Date of Patent: Dec. 7, 2004

(54) PLANAR ANTENNAS OF THE SLOT TYPE

(75) Inventors: Ali Louzir, Rennes (FR); Franck Thudor, Rennes (FR); Bernard Denis, Saint Senoux (FR); François Baron, Chatou (FR); Françoise Le Bolzer, Rennes (FR)

(73) Assignee: Thomson Licensing S.A., Boulogne (FR)

( * ) Notice: Subject to any disclaimer, the term of this patent is extended or adjusted under 35 U.S.C. 154(b) by 0 days.

(21) Appl. No.: 10/447,968

(22) Filed: May 29, 2003

(65) Prior Publication Data

US 2003/0222824 A1 Dec. 4, 2003

(51) Int. Cl.[7] ..... H01Q 13/12
(52) U.S. Cl. ..... 343/769; 343/767
(58) Field of Search ..... 343/700 MS, 767, 343/768, 769

(56) References Cited

U.S. PATENT DOCUMENTS

| | | | | |
|---|---|---|---|---|
| 4,509,209 A | * | 4/1985 | Itoh et al. | 455/327 |
| 5,714,961 A | * | 2/1998 | Kot et al. | 343/769 |
| 5,757,326 A | | 5/1998 | Koyama et al. | 343/702 |
| 5,905,471 A | * | 5/1999 | Biebl et al. | 343/769 |
| 6,028,561 A | | 2/2000 | Takei | 343/767 |
| 2002/0027528 A1 | | 3/2002 | Okabe et al. | 343/702 |

FOREIGN PATENT DOCUMENTS

| | | | |
|---|---|---|---|
| GB | 1546571 | 5/1979 | H01Q/13/16 |

OTHER PUBLICATIONS

Cheng–Shong Hong: "Small annular slot antenna with capacitor loading" Electronics Letters, IEE Stevenage, GB, vol. 36, No. 2, Jan. 20, 2000, pp. 110–111.

A.T. Kolsrud et al: "Electronically switchable slot antenna fed by microstrip line", Antennas and Propagation Society International Symposium, 1998, IEEE Int'l Symposium, 1998, IEEE Atlanta, GA USA Jun. 21–26, 1998, pp. 1180–1183.

* cited by examiner

*Primary Examiner*—Hoang V. Nguyen
(74) *Attorney, Agent, or Firm*—Joseph S. Tripoli; Brian J. Cromarty

(57) ABSTRACT

The present invention relates to a planar antenna carried by a substrate including a slot (11) consisting of a closed curve dimensioned in order to operate at a given frequency and fed by a feed line (12) positioned so that the slot lies in a short-circuit plane of the feed line. This antenna includes, in parallel on the slot 11, at least one switching means 13 capable of assuming a closed state or an open state so as to modify the operating frequency band of the planar antenna. This antenna is particularly suitable for domestic wireless networks.

7 Claims, 4 Drawing Sheets

PLANAR ANTENNAS OF THE SLOT TYPE

This application claims the benefit, under 35 U.S.C. § 365 of French Patent Application 02/06674, filed May 31, 2002.

The present invention relates to a planar antenna, more particularly to a multiband planar antenna of the slot type suitable for wireless networks, in particular for wireless networks operating in separate frequency bands.

BACKGROUND OF THE INVENTION

In the scope of deploying mobile or domestic wireless networks, the design of the antennas is confronted with a particular problem which stems from the way in which the various frequencies are allocated to these networks. For instance, in the case of domestic wireless networks in the IEEE802.11a or Hiperlan2 standard, two separate frequency blocks operating in the 5 GHz band have been allocated to the various operators, as can be seen from the table below.

TABLE A

| Technology | Application | Frequency band (GHz) |
|---|---|---|
| Europe BRAN/ HYPERLAN2 | Domestic networks | (5.15–5.35) (5.47–5.725) |
| US-IEEE 802.11a | Domestic networks | (5.15–5.35) (5.725–5.825) |

In order to cover both frequency bands, whether for a single standard or for both standards simultaneously, a variety of solutions have been proposed. The most obvious solution consists in using an antenna with a wide frequency band which covers both frequency bands at the same time. This type of wide-frequency-band antenna is generally complex in structure and high in cost. The use of a wide-band antenna also has other drawbacks, such as the degradation of the performance of the receiver due to the noise bandwidth and the jammer which can operate throughout the band covered by the antenna, this band also including the band unallocated to the specific applications which lie between 5.35 GHz and 5.47 GHz. Using a wide-frequency-band antenna involves more stringent filtering constraints for the transmitter, in order to comply with the out-of-band transmission power masks or profiles, namely the maximum powers which are allowed to be transmitted inside the allocated band, but also outside this band. This leads to additional losses and extra cost for the equipment.

In wireless networks, at a given instant, the antenna furthermore covers a channel having a width of about 20 MHz, lying in one or the other of the two bands. One solution making it possible to avoid the drawbacks associated with wide-frequency-band antennas might be to use an antenna whose frequency band can be tuned electronically.

Planar antennas which, as represented in FIG. 1, consist of an annular slot 1 operating at a given frequency f are also known, the slot being fed by a feed line 2. More precisely, on a substrate consisting of a usual printed circuit metallized on both of its faces, the annular slot 1 which may be circular in shape, but which may also have any other closed shape, is produced conventionally by etching on the side intended to constitute the earth plane of the antenna. The feed line 2 is intended to feed the slot 1 with energy by electromagnetic coupling. For example, it consists of a line produced in microstrip technology, which is positioned on the other side of the substrate from the slot 1 and is oriented radially with respect to the circle which forms this slot, in the embodiment which is represented.

In this embodiment, the microstrip line-annular slot transition of the antenna is produced in a known fashion so that the slot 1 lies in a line short-circuit plane, that is to say in a region where the currents are strongest. Hence, $lm=k\lambda m/4$, where $\lambda m$ is the wavelength being guided in the line and k is an odd integer. The length l'm is chosen in order to achieve 50 Ω matching of the line 2. In this case, the perimeter p of the slot 1 is chosen to be equal to a multiple m of the wavelength being guided in the slot, m being a positive whole number. Hence, $P=2\pi R=m\lambda$, where $\lambda$ is the wave length being guided in the slot. In this case, the resonant frequencies of the various modes are in practice multiples of the frequency f, these modes corresponding to the fundamental mode, the higher mode etc.

An antenna of this type can hence be modelled around its resonant frequency f by a parallel RLC circuit, such as represented in FIG. 2. The relationship $LC\omega^2=1$ is therefore obtained at the resonant frequency, with $\omega=2\pi f$, f being equal to the resonant frequency.

The antenna described above offers the particular advantage of having a compact structure and of being easy to produce. It is furthermore known to the person skilled in the art that the equivalent circuit of a diode, in particular a PIN diode, is a capacitive circuit when the diode is in the OFF state or an inductive circuit when the diode is in the ON state.

SUMMARY OF THE INVENTION

The present invention therefore relates to an improvement to planar antennas of the annular slot type, which makes it possible to provide coverage of a plurality of frequency bands while avoiding the drawbacks and difficulties associated with wide-frequency-band antennas.

The present invention hence relates to a planar antenna carried by a substrate including a slot consisting of a closed curve dimensioned in order to operate at a given frequency and fed by a feed line positioned so that the slot lies in a short-circuit plane of the feed line, characterized in that it includes, in parallel on the slot, a plurality of switching means capable of assuming a closed state or an open state so as to modify the central frequency and the width of the operating frequency band of the planar antenna.

The switching means preferably consist of a diode or a varactor allowing continuous adjustment of the frequency. According to an alternative embodiment, a diode is at least put in parallel with a varactor. Furthermore, the switching means is or are fitted in parallel, as a function of the resonant frequency desired for the antenna, between the electrical short-circuit plane for the slot, giving a minimum value, and the electrical open-circuit plane for the slot, giving a maximum value.

BRIEF DESCRIPTION OF THE DRAWINGS

Other characteristics and advantages of the present invention will become apparent on reading the description given below of a preferred embodiment with reference to the drawings in which.

DESCRIPTION OF THE EMBODIMENTS

To simplify the description in the figures, the same elements bear the same references.

Figure 1:
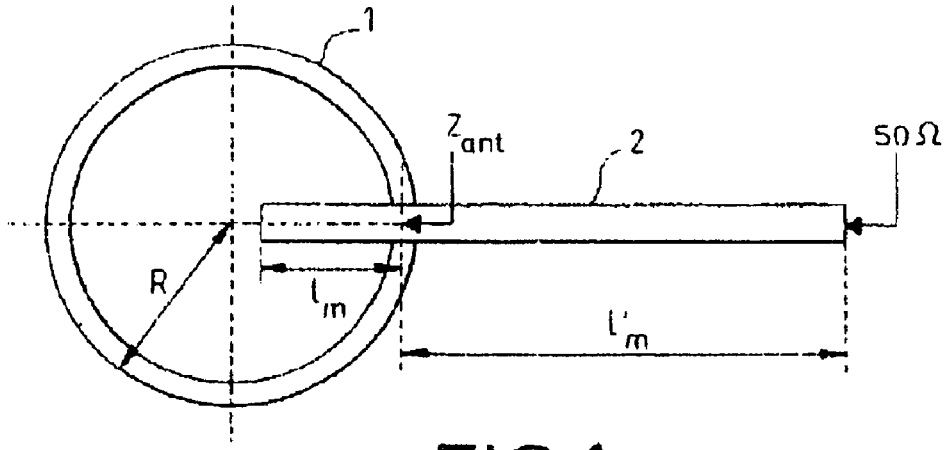
FIG. 1, already described, represents a planar antenna of the annular slot type according to the prior art.
Figure 3:
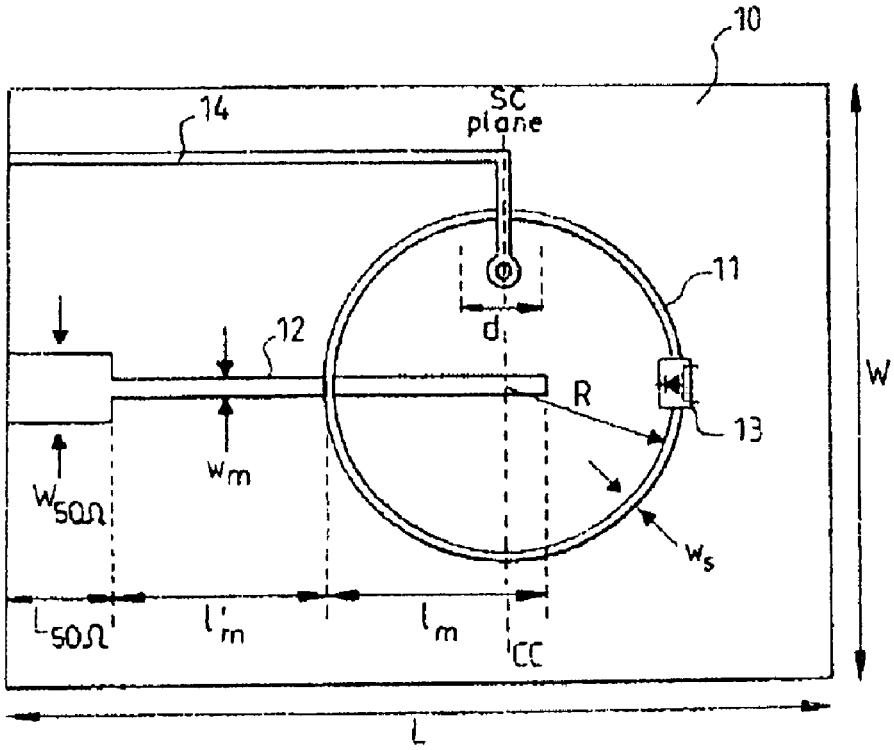
FIG. 3 is a plan view of one embodiment of the present invention.
Figure 2:
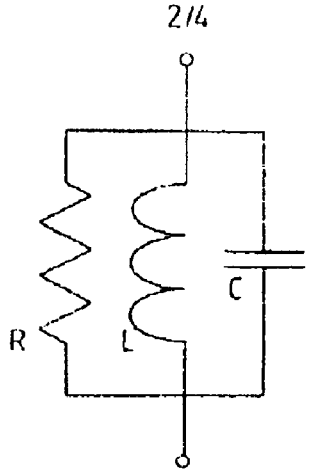
FIG. 2 is an equivalent circuit diagram of the antenna in FIG. 1.

A first embodiment of the present invention will be described first with reference to FIGS. 3 to 5. Hence, as represented in FIG. 3, the planar antenna according to the present invention consists of an annular slot 11 produced in a known fashion on a substrate 10. This annular slot 11 is fed by a feed line 12, more particularly a microstrip line connected to a radiofrequency feed. Furthermore, as represented in FIG. 3, a feed line 14 terminated by a metallized hole provides the continuous control of the antenna. An antenna of this type was produced for the measurements. In this case, the antenna is produced on an RO4003 substrate having a height h=0.81 mm, a dielectric constant $\in r=3.38$ and a tangent $\delta=0.0022$. In this case, the substrate which is metallized in a known fashion forms an earth plane of length L=35 mm and of width W=30 mm. The annular slot has a radius R=6.7 mm, a width Ws=0.4 mm. The microstrip line 12 is placed so s that the slot 11 lies in a short-circuit plane of the feed line. Therefore, the feed line 12 overlaps the slot 11 by a length $lm=k\lambda m/4$, where $\lambda m$ is the wavelength being guided in the line and k is an odd integer. In the present case, l'm=lm=8.5 mm. The width of the line 12 Wm=0.3 mm. Furthermore, the feed line 12 is terminated by a length of 50 Ω impedance line matched to the standard impedance of a connector, such that $L_{50\Omega}=4.8$ mm and $W_{50\Omega}=1.85$ mm.

According to the present invention, a diode 13, namely a PIN diode such as the HP diodes Ref: HSMP-489B in the embodiment which is represented, is positioned in parallel on the slot 11. In the embodiment of FIG. 3, the diode 13 is placed in an open-circuit plane of the slot 11. This diode 13 is connected to a control circuit (not shown) for allowing it to be put either into an OFF state or into an ON state.

The operation of an antenna of the type having an annular slot, provided with a diode in parallel, will now be explained more particularly with reference to FIGS. 4*a* and 4*b*.

Figure 4A:
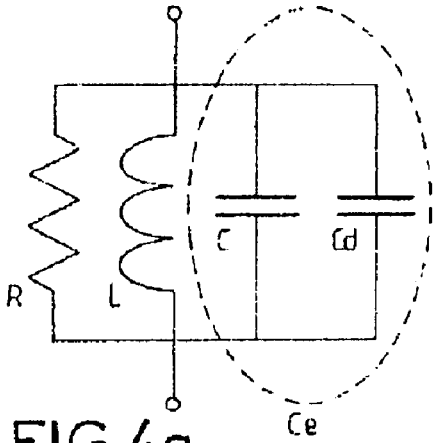
FIGS. 4*a* and 4*b* are equivalent circuit diagrams of the antenna in FIG. 3.

Knowing that when a diode is in the OFF state, its operation is capacitive operation, a circuit equivalent to that in FIG. 4*a* is therefore obtained in this case, namely two capacitors C and Cd in parallel giving a capacitance Ce whose value is such that Ce=C+Cd. In the known fashion, the resonant frequency f' of this circuit is given by the condition $LCe\omega'^2=1$, with $\omega'=2\pi f'$. Since Ce has a value higher than the value C corresponding to the slot without any diode, it can be deduced therefrom that the frequency f' is lower than the frequency f of the slot without any diode.

Figure 4B:
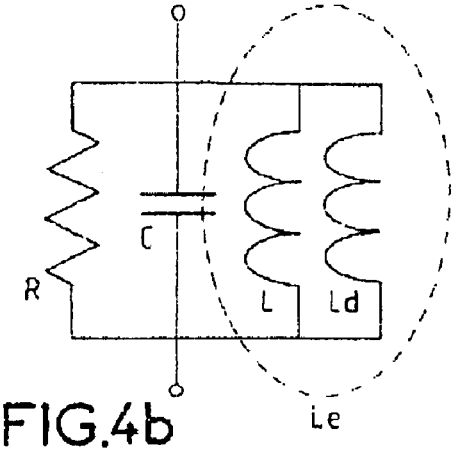

Knowing that a diode in the ON state has inductive operation, a diagram equivalent to that in FIG. 4*b* is obtained, in which the two inductances L and Ld are in parallel. In this case, the value Le of the equivalent inductance is equal to $L_e=LL_d/(L+L_d)$. In this circuit, the operating frequency f" is given by the new resonance condition $LeC\omega''^2=1$, with $\omega''=2\pi f''$. Since $L_e$ is less than L, it can be deduced that the frequency f" is higher than the frequency f of the slot without any diode. By controlling the state of the diode 13, it is hence possible to control the resonant frequency of the antenna in FIG. 3.

The effect of putting a plurality of diodes in parallel will therefore be:

1/ to increase the difference between the low frequency f' obtained for diodes in the OFF state and the frequency f in the absence of any diode, 2/ to increase the difference between the high frequency f" obtained for diodes in the ON state and the frequency f in the absence of any diode.

It is therefore possible to control the resonant frequency of the antenna in FIG. 3 over bands which are more or less wide and are more or less symmetrical with respect to the resonant frequency of a slot in the absence of any diode.

Figure 5:
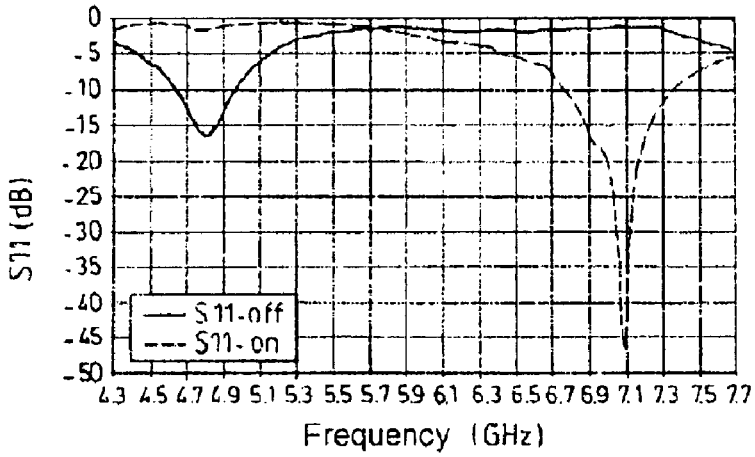
FIG. 5 represents the reflection coefficient as a function of frequency of the antenna in FIG. 3, when the diode is in an open-circuit plane for the slot, for both states of the diode: ON or OFF.

The curve in FIG. 5 clearly shows, for the antenna structure in FIG. 3, that switching the PIN diode 13 from an OFF state to an ON state makes it possible to change from a frequency of about 4.8 GHz, for the diode in the OFF state, to a frequency of about 7.1 GHz for a diode in the ON state.

Figure 6:
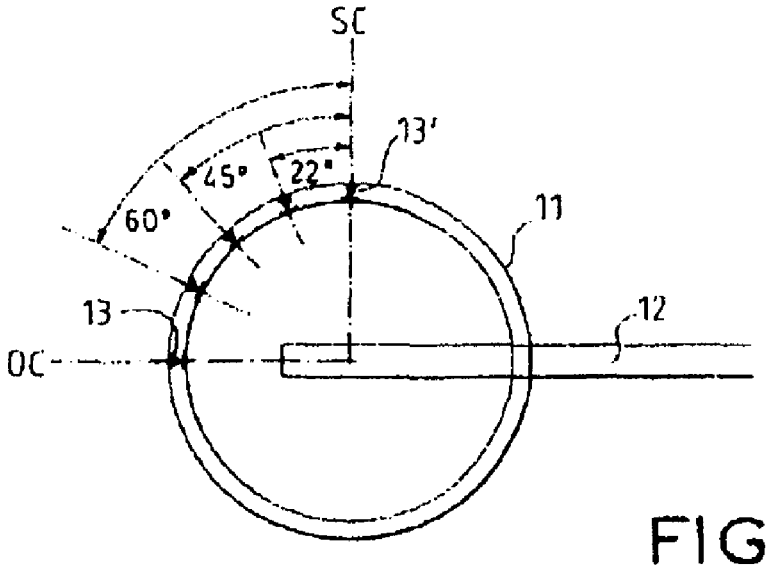
FIG. 6 is a schematic plan view of an antenna according to the present invention, showing various possible positions for the diode.
Figure 7:
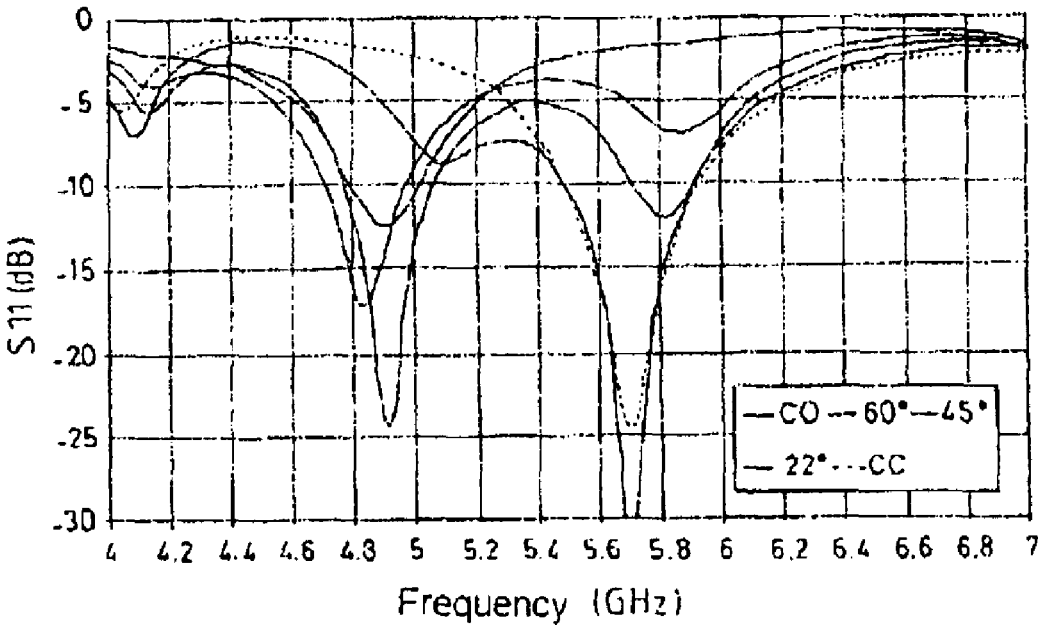
FIG. 7 represents a curve giving the reflection coefficient as a of frequency for the various possible positions for the diode.

The effect produced by the placement of the diode or diodes in the slot will now be shown with reference to FIGS. 6 and 7, this effect leading to an influence on the operating frequency of the slot.

Hence, FIG. 6 schematically represents an annular slot 11 fed, for example, by a microstrip line 12. In this figure, the diode is fitted in parallel in the slot at various positions between a position corresponding to an open-circuit plane, as for the diode 13, and a position corresponding to a short-circuit plane, as for the diode 13'. The other diodes are positioned, for example, at 22°, 45° and 60° from the short-circuit plane. The coupling of the diode with the resonant slot 11 is modified in this case, which modifies the exact value of the equivalent capacitance, in the case of an OFF state, or of the inductance in the case of ON state. When the diode 13' is placed in an electrical short-circuit plane, it hence contributes an impedance (inductive or capacitive, depending on the state) in parallel with a zero impedance. Its effect is therefore minimal. When the diode 13 is placed in an open-circuit plane, conversely, it contributes an impedance parallel with infinite impedance and its effect is maximum. The various results obtained are represented in FIG. 7, which gives the reflection coefficient S11 in dB as a function of the frequency in GHz.

Figure 8:
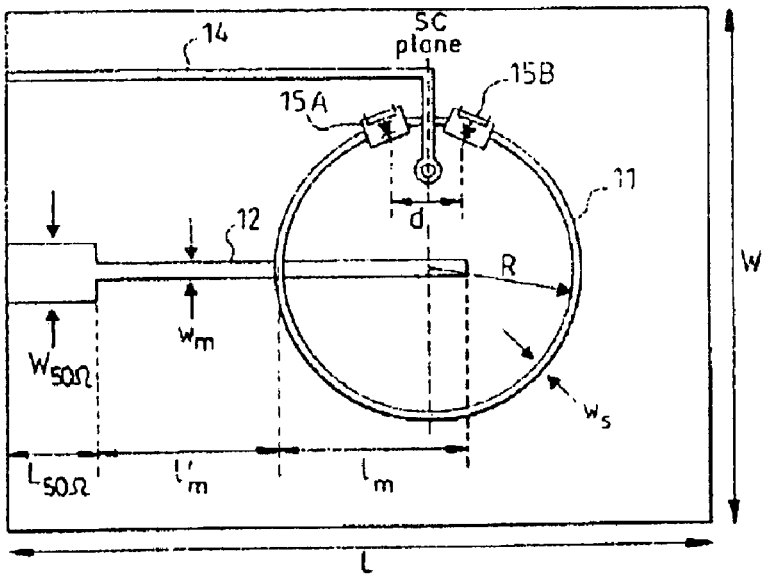
FIG. 8 is a schematic plan view of an annular slot-type antenna provided with two diodes on either side of the short-circuit plane, according to another embodiment of the present invention.
Figure 9:
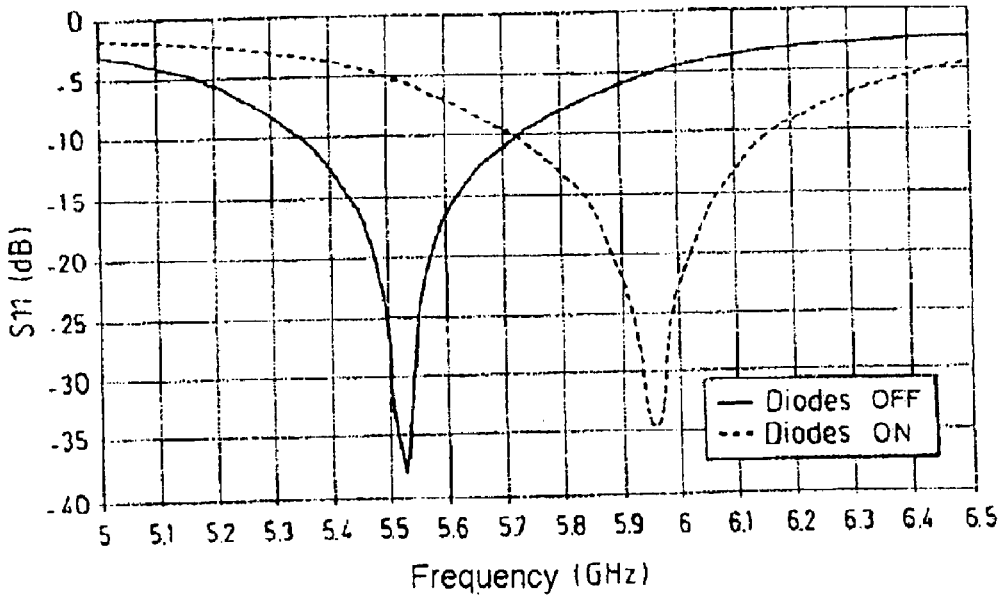
FIG. 9 is a diagram giving the reflection coefficient as a function of frequency for the antenna in FIG. 8 for both states of the diode.

FIGS. 8 and 9 represent an alternative embodiment of the present invention. FIG. 8 represents a planar antenna consisting, as FIG. 3, of a slot antenna 11 fed by a microstrip line 12, a microstrip line 14 controlling the continuous value of the antenna. In this case, as represented in FIG. 8, two diodes 15A, 15B are fitted in parallel on the slot on either side of the short-circuit plane for the slot, referenced SC plane. In this embodiment, the distance d between the two diodes 15A, 15B is equal to 2.8 mm. When the diodes change from the OFF state to the ON state in this case, the operating frequency changes from 5.54 GHz to 5.94 GHz as represented in FIG. 9, which gives the reflection coefficient S11 in dB as a function of the frequency in GHz. A frequency shift of 500 MHz is therefore observed.

Radiation diagram measurements were furthermore carried out in an anechoic chamber with an antenna model as represented in FIG. 8, and having the dimensions given above. It is found in this case that the diodes do not perturb the basic radiation of the annular slot.

The present invention has been described with reference to PIN diodes as the switching means. It is clear to the person skilled in the art that other switching means may be used, in particular varactors which allow quasi-continuous control of the resonant frequency in a given frequency range. Specifically, a varactor is an electronic component (typically a reverse-biased diode) which makes it possible to control the junction capacitance (OFF-state diode) which decreases as a function of the voltage applied to its terminals. It is hence possible to modify the resonant frequency of the antenna continuously by modifying the bias voltage of the varactor. The varactors may be associated with at least one of the PIN diodes, so as to allow quasi-continuous frequency control over one or more ranges. The slot may furthermore have a closed shape other than an annular shape. It may have a polygonal shape such as square, triangular, rectangular. The invention described above therefore provides a compact and inexpensive planar antenna which can operate in multiple frequency bands corresponding, in particular, to the IEEE802.11a or Hyperlan2 standard.

What is claimed is:

1. Planar antenna carried by a substrate including a slot consisting of a closed curve dimensioned in order to operate at a given frequency and fed by a feed line positioned so that the slot lies in a short-circuit plane of the feed line, including, in parallel on the slot, a plurality of switching means capable of assuming a closed state or an open state so as to modify the central frequency and the width of the operating frequency band of the planar antenna.

2. Antenna according to claim 1, wherein the switching means are fitted, in parallel as a function of the desired resonant frequency of the antenna, between the electrical short-circuit plane for the slot, giving a minimum value, and the electrical open-circuit plane for the slot, giving a maximum value.

3. Antenna according to claim 1, wherein the switching means consists of a diode.

4. Antenna according to claim 3, wherein at least one diode is put in parallel with a varactor.

5. Antenna according to claim 1, wherein switching means consists of a varactor.

6. Antenna according to claim 5, wherein at least one diode is put in parallel with a varactor.

7. Antenna according to claim 1, wherein the slot is annular or polygonal in shape.

* * * * *